US007657053B2

(12) United States Patent
Kosuda

(10) Patent No.: US 7,657,053 B2
(45) Date of Patent: Feb. 2, 2010

(54) SPEAKER UNIT

(75) Inventor: Kazuyuki Kosuda, Osaka (JP)

(73) Assignee: Sanyo Electric Co., Ltd., Moriguchi-Shi (JP)

( * ) Notice: Subject to any disclaimer, the term of this patent is extended or adjusted under 35 U.S.C. 154(b) by 829 days.

(21) Appl. No.: 11/257,082

(22) Filed: Oct. 25, 2005

(65) Prior Publication Data

US 2006/0088177 A1 Apr. 27, 2006

(30) Foreign Application Priority Data

Oct. 27, 2004 (JP) ..... 2004-312639

(51) Int. Cl.
*H04R 25/00* (2006.01)

(52) U.S. Cl. ..... 381/395; 381/386; 381/396

(58) Field of Classification Search ..... 381/191, 381/395–396, 398, 400, 407, 411, 433, 386
See application file for complete search history.

(56) References Cited

U.S. PATENT DOCUMENTS 2,498,825 A * 2/1950 Richards ..... 381/433
6,567,529 B1 * 5/2003 Roark ..... 381/433

FOREIGN PATENT DOCUMENTS

JP 2000-350286 12/2000
JP 2004-48223 2/2004

* cited by examiner

*Primary Examiner*—Suhan Ni
(74) *Attorney, Agent, or Firm*—Westerman, Hattori, Daniels & Adrian, LLP

(57) ABSTRACT

In a speaker unit of the present invention, a diaphragm with an aspect ratio exceeding one is provided in an internal space of a frame. The frame has both ends thereof provided with a pair of air holes opening on a rear surface, and a pair of electrode members attached thereto. Each of the electrode members includes a clamping portion to be fixed to an end of the frame, and an elastic arm portion extending from the clamping portion along the frame. The elastic arm portion is opposed to the air hole. A clamping portion rear area and a main body rear area having the air hole opened thereon are formed on the rear surface of the frame. The main body rear area is formed lower than the clamped portion rear area in a direction apart from the elastic arm portion of the electrode member.

2 Claims, 9 Drawing Sheets

SPEAKER UNIT

The priority application Number 2004-312639 upon which this patent application is based is hereby incorporated by reference.

BACKGROUND OF THE INVENTION

1. Field of the Invention

The present invention relates to a speaker unit to be incorporated in a small-sized electronic device such as a portable telephone, digital camera, etc.

2. Description of Related Art

Disk-type speaker units using a circular diaphragm have been conventionally a mainstream of such a kind of speaker unit (see JP 2004-48223, A), while track-type speaker units using a diaphragm in an elliptical shape or a track shape with an aspect ratio exceeding one have been developed in recent years (see JP 2000-350286, A).

In a track-type speaker unit 4 shown in FIG. 16 to FIG. 20, for example, a diaphragm 6 with an aspect ratio exceeding one and a drive mechanism 7 including a coil 71 for driving the diaphragm 6 are provided, as shown in FIG. 16 and FIG. 17, in an internal space of a frame 41 made of a synthetic resin. As shown in FIG. 17, a pair of air holes 42, 42 opening on a rear surface opposite to a sound-emitting surface 40 are provided at both ends in a longitudinal direction of the frame 41. Each of the air holes 42 is covered with a mesh sheet 8.

Furthermore, as shown in FIG. 18 to FIG. 20, a pair of electrode members 5, 5 for externally supplying power to the coil 71 are attached to the vicinity of the mesh sheet 8 covering the pair of air holes 42, 42 at the both ends in the longitudinal direction of the frame 41. Each of the electrode members 5 is made of a sheet metal, and includes a clamping portion 51 with a U-shaped cross section for clamping an end of the frame 41 and being fixed to the end, and an elastic arm portion 52 extending from the clamping portion 51 inclined against the rear surface of the frame 41.

FIG. 21 illustrates a process of attaching each of the electrode members 5 to the frame 41. As shown, each clamped portion 43 is provided at either end in the longitudinal direction of the frame 41. An adhesive is applied to any one of three inner wall surfaces forming the clamping portion 51 of the electrode member 5, and then the clamping portion 51 is fitted into the clamped portion 43 of the frame 41. As a result, the electrode member 5 is bonded and fixed to the frame 41 with the clamping portion 51 of the electrode member 5 clamping the clamped portion 43 of the frame 41. Thereafter, a pair of conductors (not shown) led from the coil 71 of the drive mechanism 7 shown in FIG. 17 are each soldered to the clamping portion 51 of the electrode member 5 to complete assembly of the speaker unit 4.

In a process of incorporating the speaker unit 4 thus assembled into an electronic device such as a portable telephone or the like, as shown in FIG. 15, the speaker unit 4 is placed as opposed to a sound-emitting opening 13 of one case half 1 of a casing, and thereafter the case half 1 and the other case half 11 are joined to each other with a circuit board 12 held therebetween.

As a result, the electrode member 5 of the speaker unit 4 is press-contacted with a pad (not shown) formed on a surface of the circuit board 12 to produce an electrical connection between the circuit board 12 and the speaker unit 4. In this state, the elastic arm portion 52 of the electrode member 5 elastically deforms as shown in FIG. 22, and an elastic return force thereof maintains the press-contact of the elastic arm portion 52 to the pad.

However, in the conventional speaker unit 4, the electrode member 5 elastically deforms as shown in FIG. 22 due to the assembling process shown in FIG. 15, and comes close to a rear surface 44 of the frame 41. Consequently, the air hole 42 shown in FIG. 17 is slightly closed by the elastic arm portion 52 of the electrode member 5.

Especially, the speaker unit 4 in recent years has been made thinner, so that the elastic arm portion 52 of the electrode member 5 deforms to a posture approximately parallel to the rear surface 44 of the frame 41. Consequently, space between the electrode member 5 and the frame 41 becomes smaller and smaller, which makes an air flow accompanying a sound of the speaker unit 4 poorer. Accordingly, there has been a problem that expected low-frequency acoustic characteristics cannot be obtained.

In the conventional disk-type speaker unit, the above problem can be relatively easily solved by staggering a position of the air hole of the frame and a position of the electrode member. However, it is difficult in the track-type speaker unit to stagger a position of the air hole of the frame and a position of the electrode member because of design constraint on the position of the air hole of the frame.

SUMMARY OF THE INVENTION

An object of the present invention is to provide a speaker unit in which expected low-frequency acoustic characteristics can be obtained even if a position of an air hole of a frame and a position of an electrode member overlap.

In a speaker unit of the present invention, a diaphragm 6 with an aspect ratio exceeding one and a drive mechanism 7 for driving the diaphragm 6 are provided in an internal space of a frame 21 made of a synthetic resin. A pair of air holes 22, 22 opening on a rear surface opposite to a sound-emitting surface 20 are provided at both ends of the frame 21, while a pair of electrode members 3, 3 for supplying power to the drive mechanism 7 are attached to the vicinity of the both air holes 22, 22.

Each of the electrode members 3 includes a clamping portion 31 for clamping a clamped portion 23 provided at an end of the frame 21 and being fixed to the clamped portion 23, and an elastic arm portion 32 extending from the clamping portion 31 along the rear surface of the frame 21. The elastic arm portion 32 is opposed to an opening of the air hole 22.

A clamped portion rear area 26 to be in contact with the clamping portion 31 of the electrode member 3 and a main body rear area 27 having the air hole 22 opened as opposed to the elastic arm portion 32 of the electrode member 3 are formed on the rear surface of the frame 21. The main body rear area 27 is formed lower than the clamped portion rear area 26 in a direction apart from the elastic arm portion 32 of the electrode member 3.

Specifically, the electrode member 3 is made of a sheet metal, and the clamping portion 31 has a U-shaped cross section, while the elastic arm portion 32 is in the form of a band plate.

In the above-described speaker unit of the present invention, although the elastic arm portion 32 of the electrode member 3 elastically deforms due to an assembling process of a casing of an electronic device, and comes close to the rear surface of the frame 21, a step is formed between the clamped portion rear area 26 of the frame 21, which is to define a height position of a base end of the elastic arm portion 32 of the electrode member 3, and the main body rear area 27, which is to be opposed to the elastic arm portion 32 of the electrode member 3, so that a space corresponding to the step is provided between the elastic arm portion 32 and the main body rear area 27, and the air hole 22 of the frame 21 is thereby maintained to be widely open even if the elastic arm portion 32 of the electrode member 3 elastically deforms to a posture approximately parallel to the main body rear area 27 of the frame 21. As a result, an air flow accompanying a sound of the speaker unit is kept to be good, so that expected low-frequency acoustic characteristics can be obtained.

According to the speaker unit of the present invention, as described above, expected low-frequency acoustic characteristics can be obtained even if a position of the air hole of the frame and a position of the electrode member overlap.

DETAILED DESCRIPTION OF THE INVENTION

Figure 4:
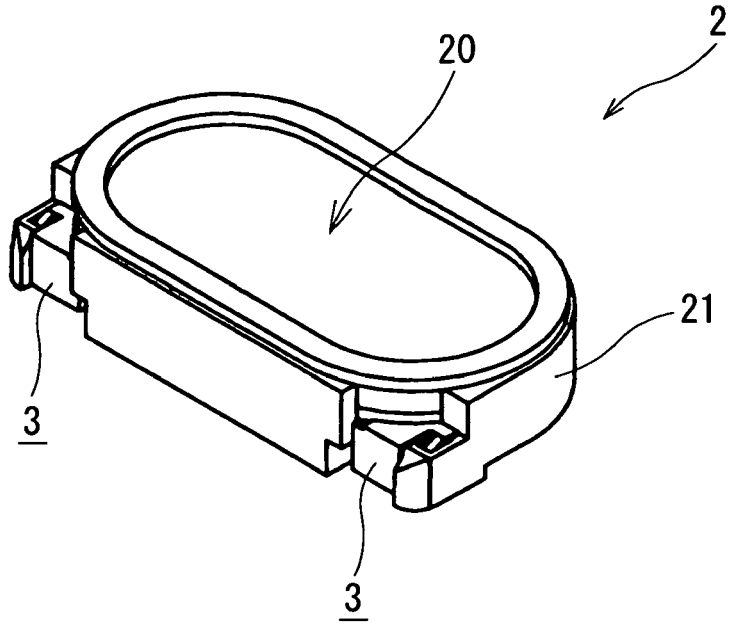
FIG. 4 is a perspective view of the speaker unit viewed from a sound-emitting surface side.
Figure 5:
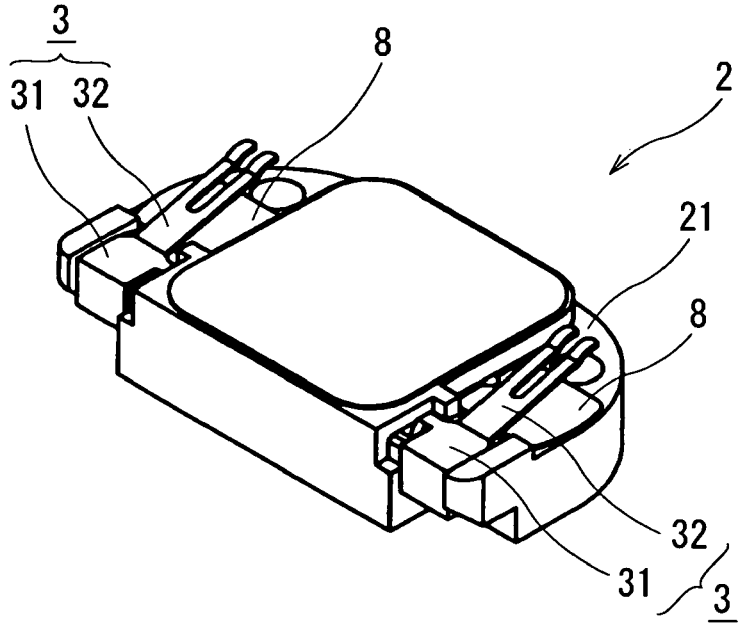
FIG. 5 is a perspective view of the speaker unit viewed from a rear surface side.

An embodiment of the present invention will be specifically described below with reference to the drawings. As shown in FIG. 4 and FIG. 5, a speaker unit 2 of the present invention includes a frame 21, which is made of a synthetic resin, and is flat and generally in the form of a rectangle, longer in one direction. A pair of electrode members 3, 3 made of a sheet metal are attached to both ends in a longitudinal direction of the frame 21 to constitute a track-type speaker unit having a sound-emitting surface 20 with a bore of 11 mm×20 mm.

Figure 2:
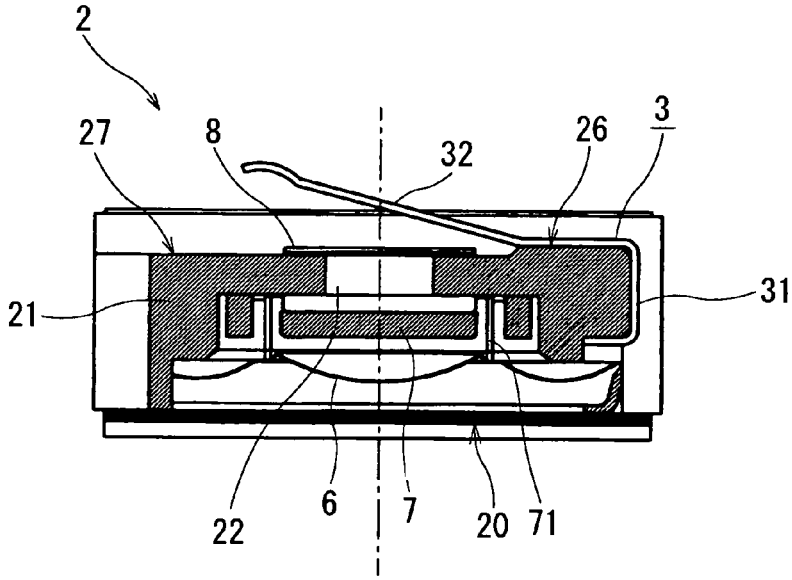
FIG. 2 is a sectional view in a direction along a short axis of the speaker unit.
Figure 3:
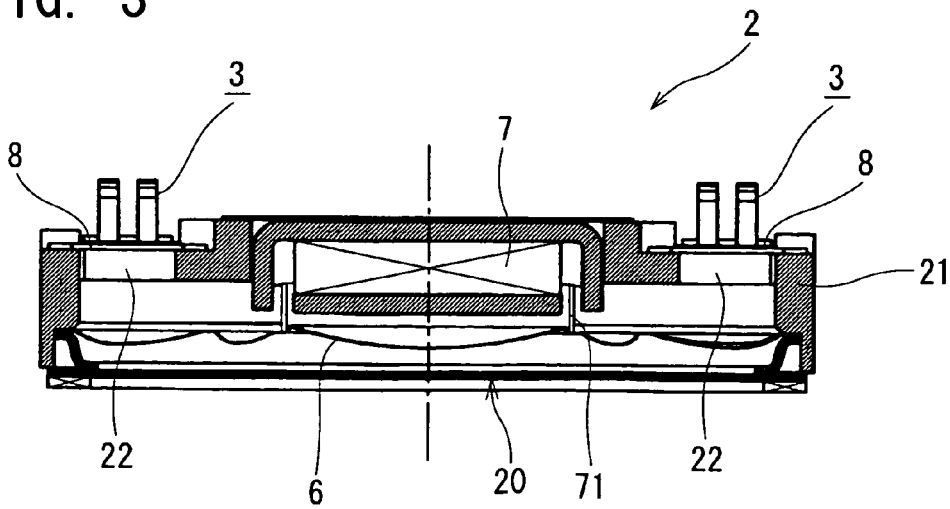
FIG. 3 is a sectional view in a direction along a long axis of the speaker unit.

As shown in FIG. 2 and FIG. 3, a diaphragm 6 with an aspect ratio exceeding one and a drive mechanism 7 including a coil 71 for driving the diaphragm 6 are provided in an internal space of the frame 21. As shown in FIG. 3, a pair of air holes 22, 22 opening on a rear surface opposite to the sound-emitting surface 20 are provided in the both ends in the longitudinal direction of the frame 21. Each of the air holes 22 is covered by a mesh sheet 8.

Figure 10:
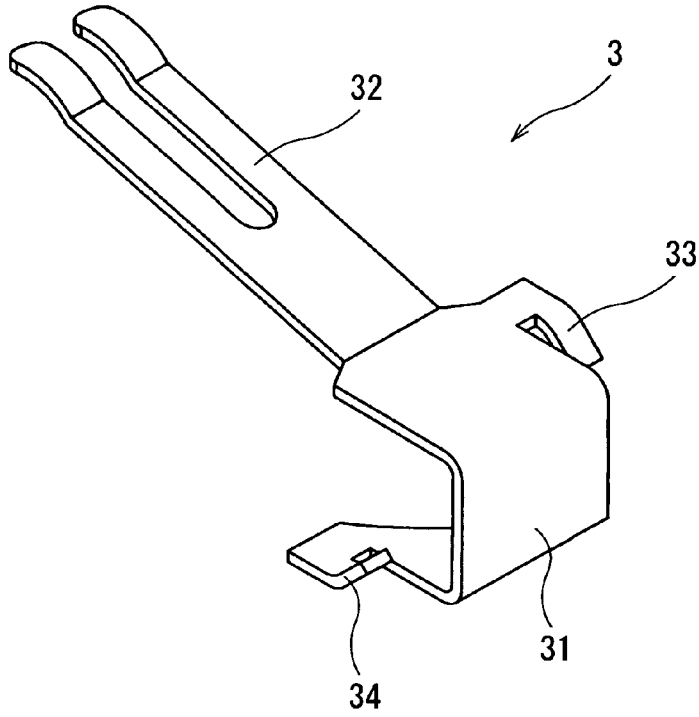
FIG. 10 is an enlarged perspective view of the electrode member.
Figure 11:
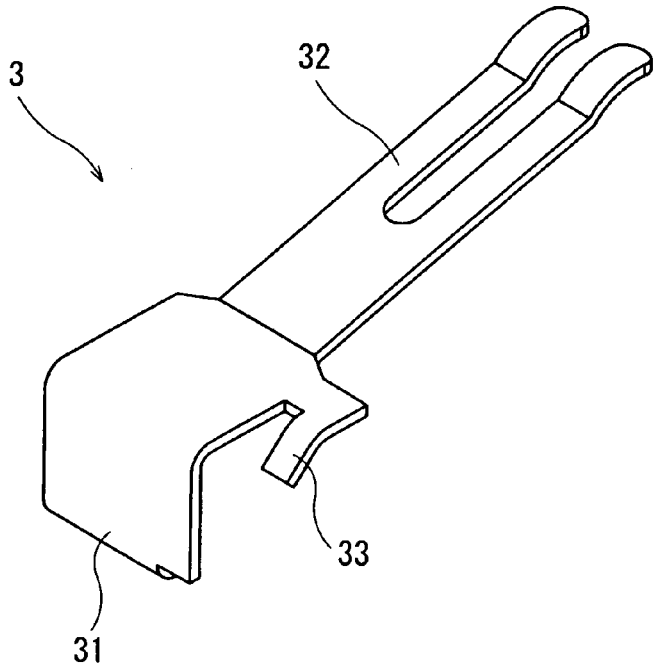
FIG. 11 is an enlarged perspective view of the electrode member viewed from another direction.

As shown in FIG. 10 and FIG. 11, the electrode member 3 includes a clamping portion 31 with a U-shaped cross section and a band plate-like elastic arm portion 32 projecting in one direction from one end of the clamping portion 31. A first locking piece 33 and a second locking piece 34 each projecting in an L-shape and having an end thereof curved inwardly of the clamping portion 31 are formed in stagger and diagonal positions at both side edges of a U-shaped portion of the clamping portion 31. The electrode member 3 is prepared through the steps of cutting a spring plate material into a shape shown in FIG. 12, and plastically working the material by press into a shape shown in FIG. 10 and FIG. 11.

Figure 12:
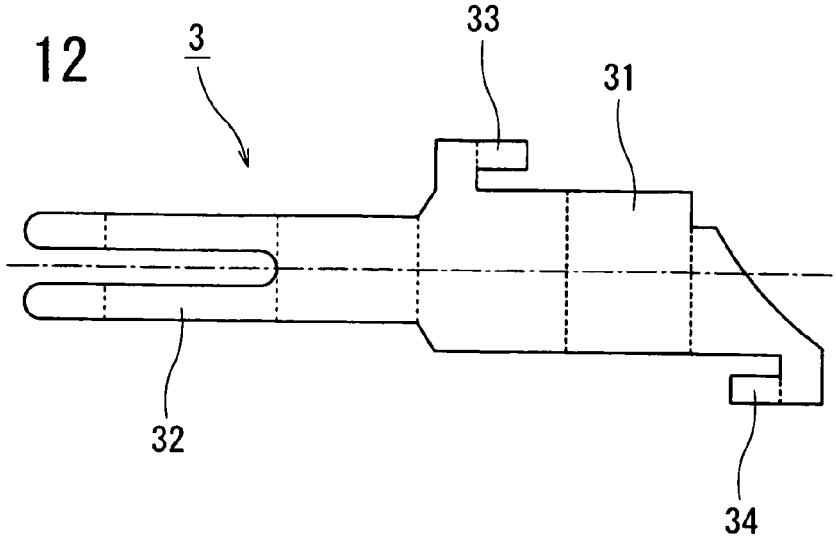
FIG. 12 is a developed plan view of the electrode member.

As shown in FIG. 12, the first locking piece 33 and the second locking piece 34 are projected in diagonal positions of the developed clamping portion 31. The ends of the two locking pieces 33, 34 extend in directions to come closer to each other, and form L-shapes. Thus, the first locking piece 33 and the second locking piece 34 are projected in diagonal positions of the developed clamping portion 31, and therefore no trouble is caused in the cutting process.

Figure 8:
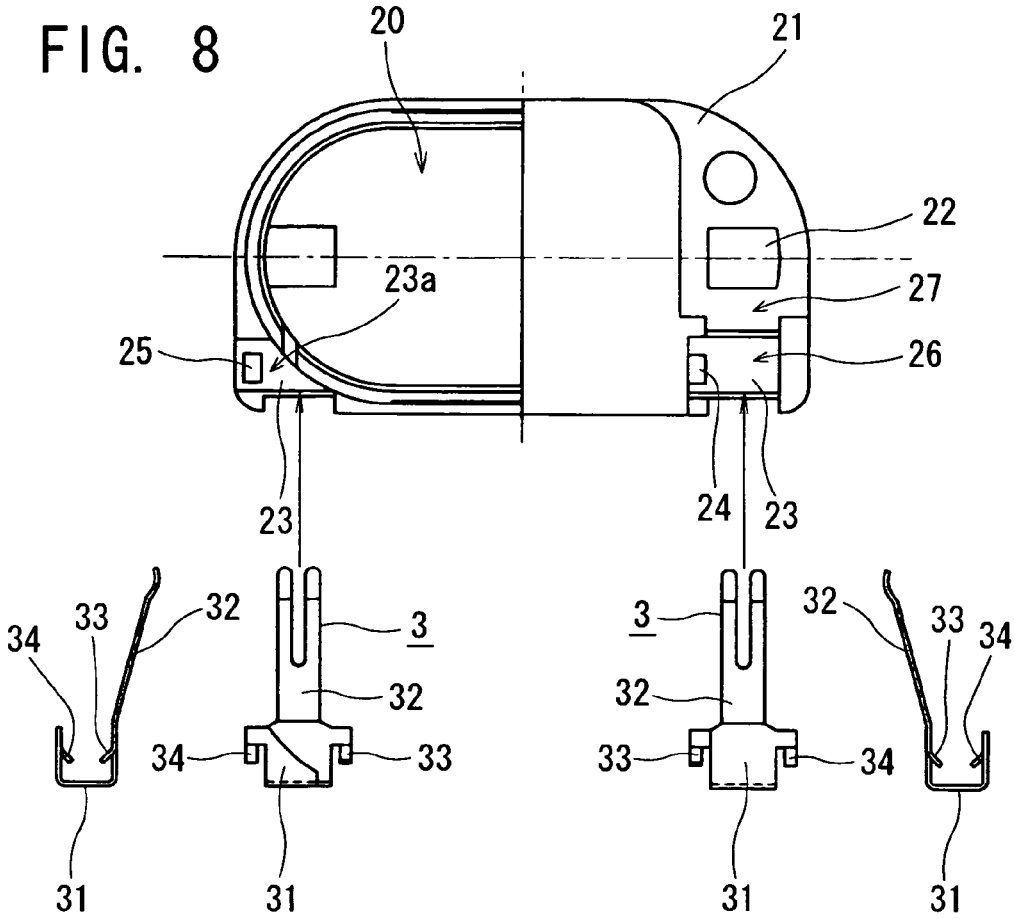
FIG. 8 illustrates a process of attaching an electrode member to a frame of the speaker unit, showing a plan vision of the frame with a left side of the center line viewed from the sound-emitting surface side and a right side viewed from the rear surface side, and a plan vision and a side vision of the electrode member.
Figure 9A:
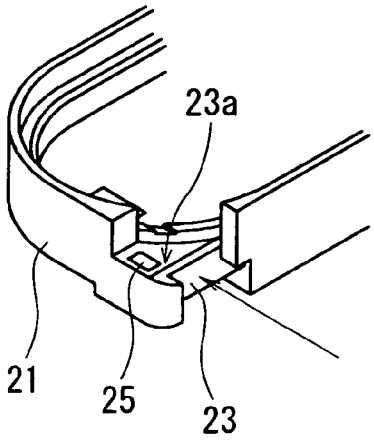
FIG. 9(*a*) and FIG. 9(*b*) are each a perspective view showing a principal portion of the frame.
Figure 9B:
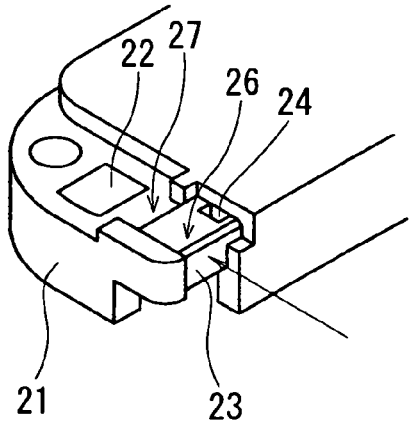

On the other hand, as shown in FIG. 8, FIG. 9(*a*) and FIG. 9(*b*), each clamped portion 23 to be clamped by the clamping portion 31 of the electrode member 3 is formed at either end in the longitudinal direction of the frame 21. The clamped portion 23 has a clamped portion front area 23*a* facing to a side of the sound-emitting surface 20 of the frame 21, and a clamped portion rear area 26 facing opposite to the sound-emitting surface 20. The clamped portion rear area 26 is formed slightly (approximately 0.20 mm) higher than a main body rear area 27 having the air hole 22 opened thereon as shown in FIG. 9(*b*), so that a slight step is provided between the clamped portion rear area 26 and the main body rear area 27.

Furthermore, the clamped portion rear area 26 of the frame 21 has a recess 24 to be engaged with the first locking piece 33 of the electrode member 3 formed on an end thereof near an inside of the frame 21, while the clamped portion front area 23*a* of the frame 21 has a recess 25 to be engaged with the second locking piece 34 of the electrode member 3 formed on an end thereof near an outside of the frame 21.

In a process of attaching each of the electrode members 3 to each of the clamped portions 23 of the frame 21, as shown in FIG. 8, an adhesive is applied to any one of three inner wall surfaces of the clamping portion 31 of the electrode member 3, and then the clamping portion 31 is pressed and fitted to the clamped portion 23 of the frame 21 with the elastic arm portion 32 covering the rear surface of the frame 21.

Figure 13:
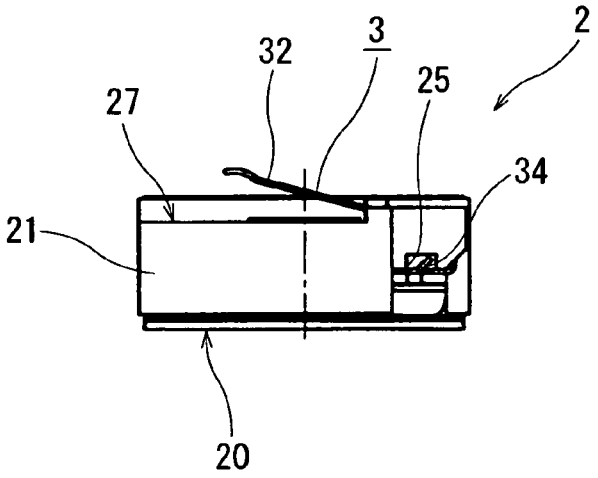
FIG. 13 illustrates an engagement of the frame and the electrode member.

As a result, the inner wall surfaces of the clamping portion 31 of the electrode member 3 are in close contact with the clamped portion front area 23*a* and clamped portion rear area 26 of the frame 21 to clamp the clamped portion 23, while the first locking piece 33 and second locking piece 34 of the clamping portion 31 are engaged with the recesses 24, 25 of the frame 21, respectively. FIG. 13 shows an engagement of the second locking piece 34 of the electrode member 3 and the recess 25 of the frame 21.

Figure 6:
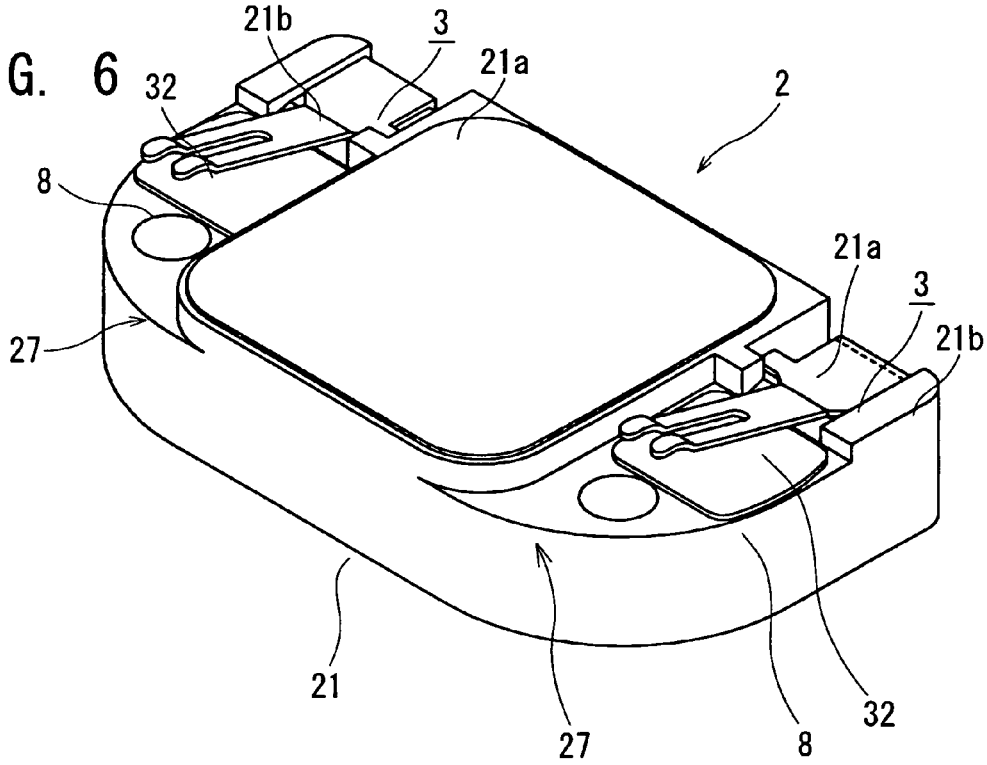
FIG. 6 is an enlarged perspective view of the speaker unit viewed from the rear surface side.
Figure 7:
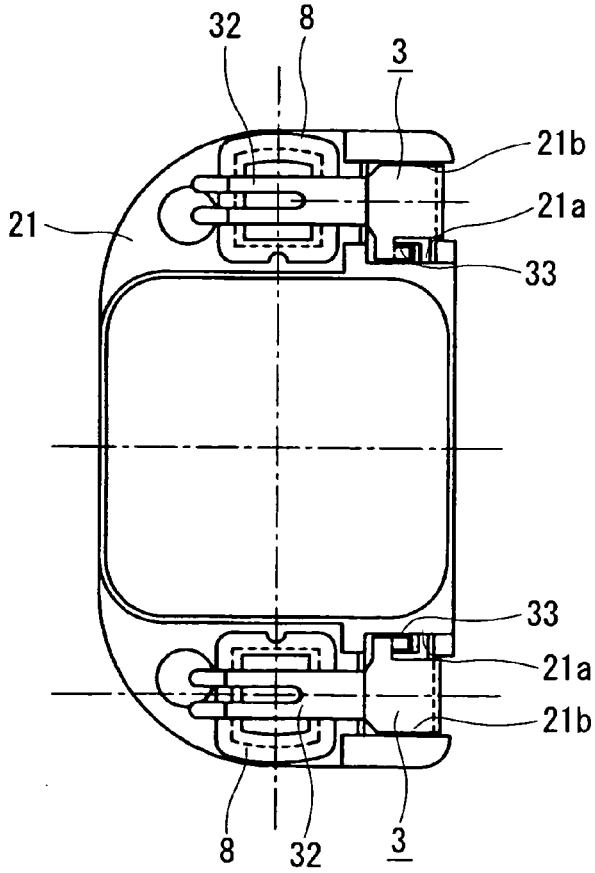
FIG. 7 is a rear view of the speaker unit.

In this state, as shown in FIG. 6 and FIG. 7, the clamping portion 31 of each of the electrode members 3 is held by guide surfaces 21*a*, 21*b* of the frame 21 formed on both sides thereof, so that movement in a width direction of the electrode member 3 is restrained. Moreover, the ends of the first locking piece 33 and the second locking piece 34 are received inside the recesses 24, 25 of the frame 21, which gives detachment prevention for the electrode member 3. The electrode member 3 can be thereby attached to the frame 21 without looseness. The elastic arm portion 32 extends in an oblique direction while opposed to the mesh sheet 8 covering the air hole 22 of the frame 21.

Thereafter, a pair of conductors (not shown) led from the coil 71 of the drive mechanism 7 shown in FIG. 3 are each soldered to the clamping portion 31 of the electrode member 3 to complete assembly of the speaker unit 2. In soldering, the electrode member 3 is temporarily joined to the frame 21 at the clamping portion 31 by the adhesive to prevent looseness, and therefore the solder paste operation is easy.

Figure 1:
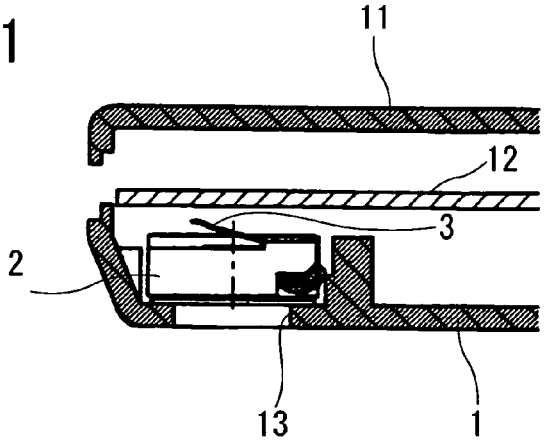
FIG. 1 is a sectional view showing a process of incorporating a speaker unit of the present invention into a casing of an electronic device.

In a process of incorporating the speaker unit 2 thus assembled into an electronic device such as a portable telephone or the like, as shown in FIG. 1, the speaker unit 2 is placed as opposed to a sound-emitting opening 13 of one case half 1 of a casing, and thereafter the case half 1 and the other case half 11 are joined to each other with a circuit board 12 held therebetween.

Figure 14:
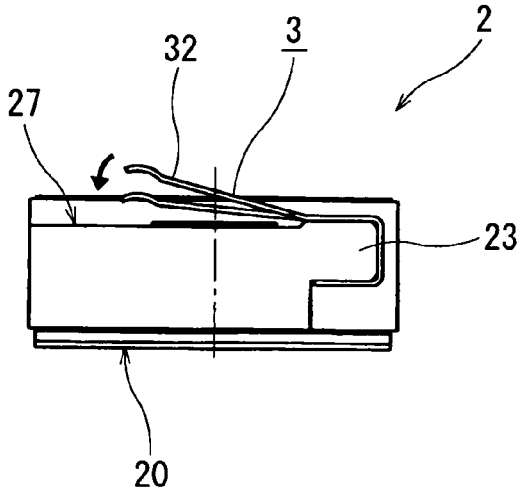
FIG. 14 illustrates an elastic deformation of the electrode member.
Figure 15:
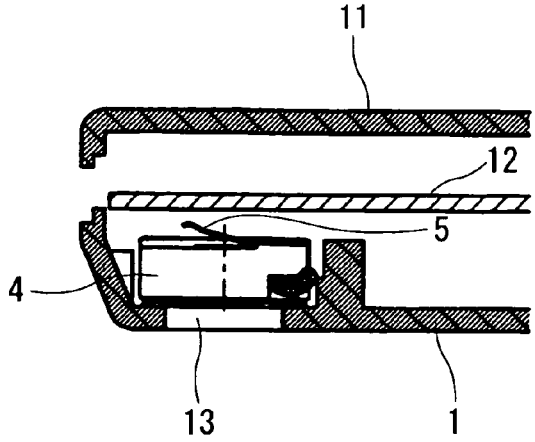
FIG. 15 PRIOR ART
FIG. 15 is a sectional view showing a process of incorporating a conventional speaker unit into a casing of an electronic device.
Figure 16:
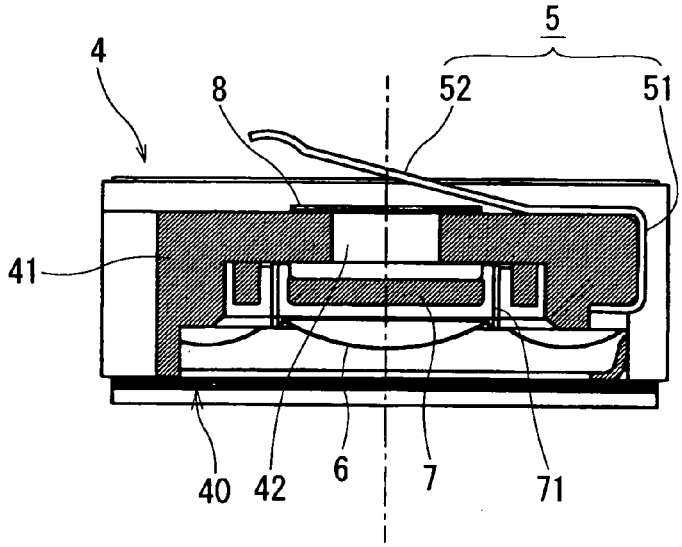
FIG. 16 PRIOR ART
FIG. 16 is a sectional view in a direction along a short axis of the speaker unit.
Figure 17:
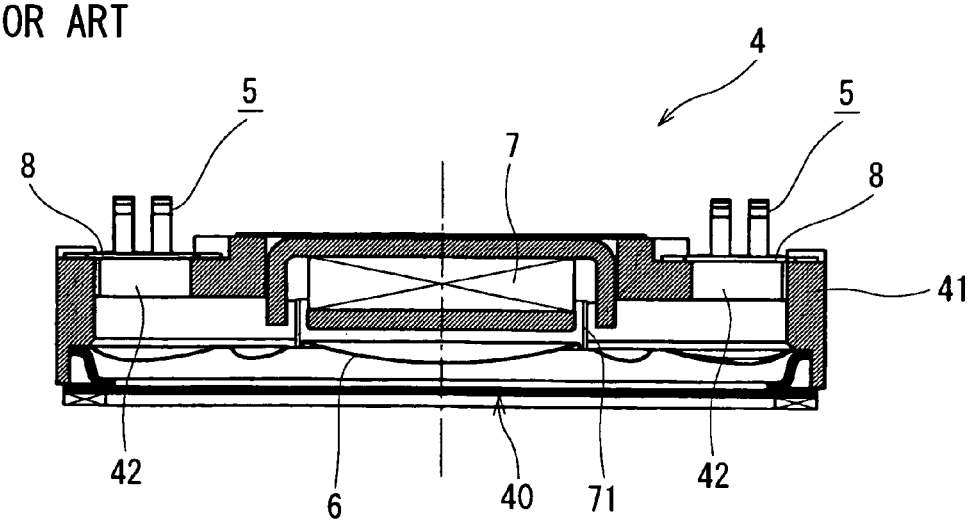
FIG. 17 PRIOR ART
FIG. 17 is a sectional view in a direction along a long axis of the speaker unit.
Figure 18:
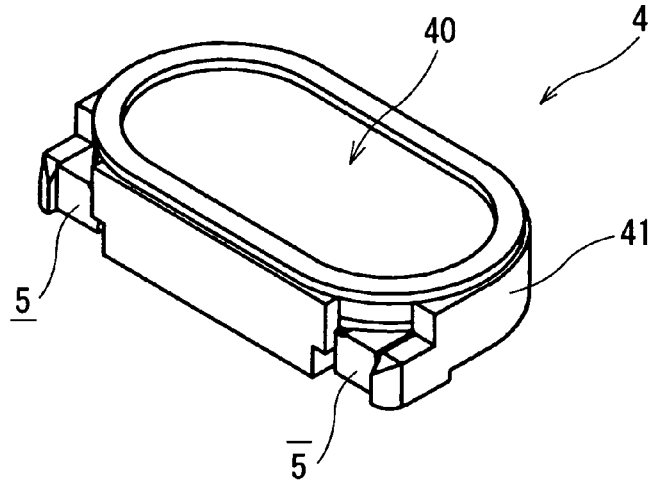
FIG. 18 PRIOR ART
FIG. 18 is a perspective view of the speaker unit viewed from a sound-emitting surface side.
Figure 19:
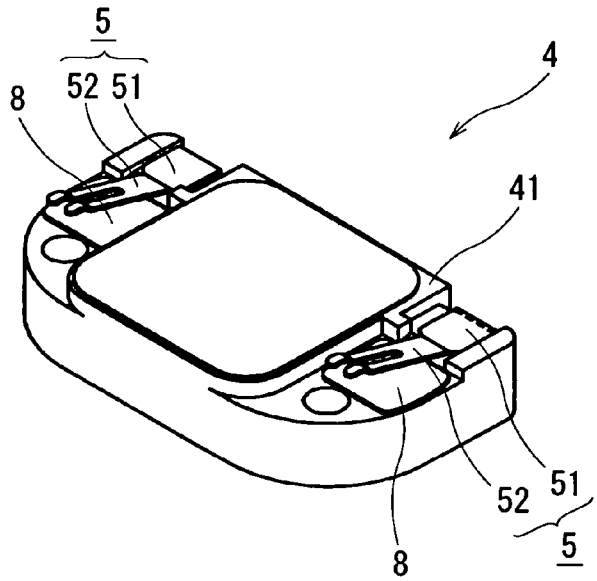
FIG. 19 PRIOR ART
FIG. 19 is a perspective view of the speaker unit viewed from a rear surface side.
Figure 20:
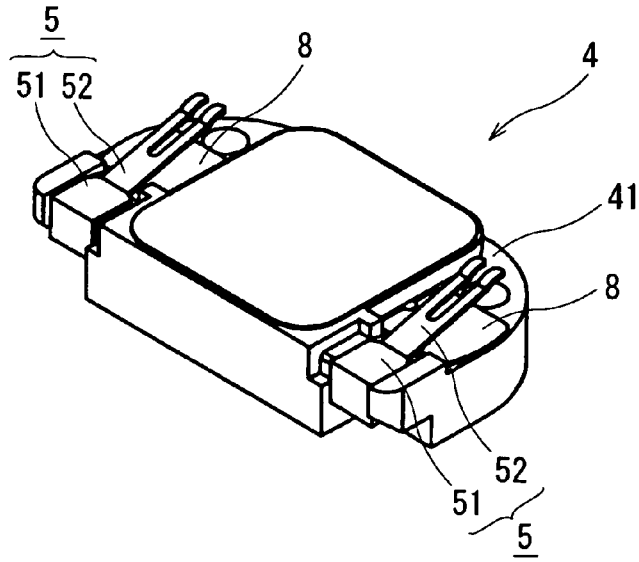
FIG. 20 PRIOR ART
FIG. 20 is a perspective view of the speaker unit viewed from another direction.
Figure 21:
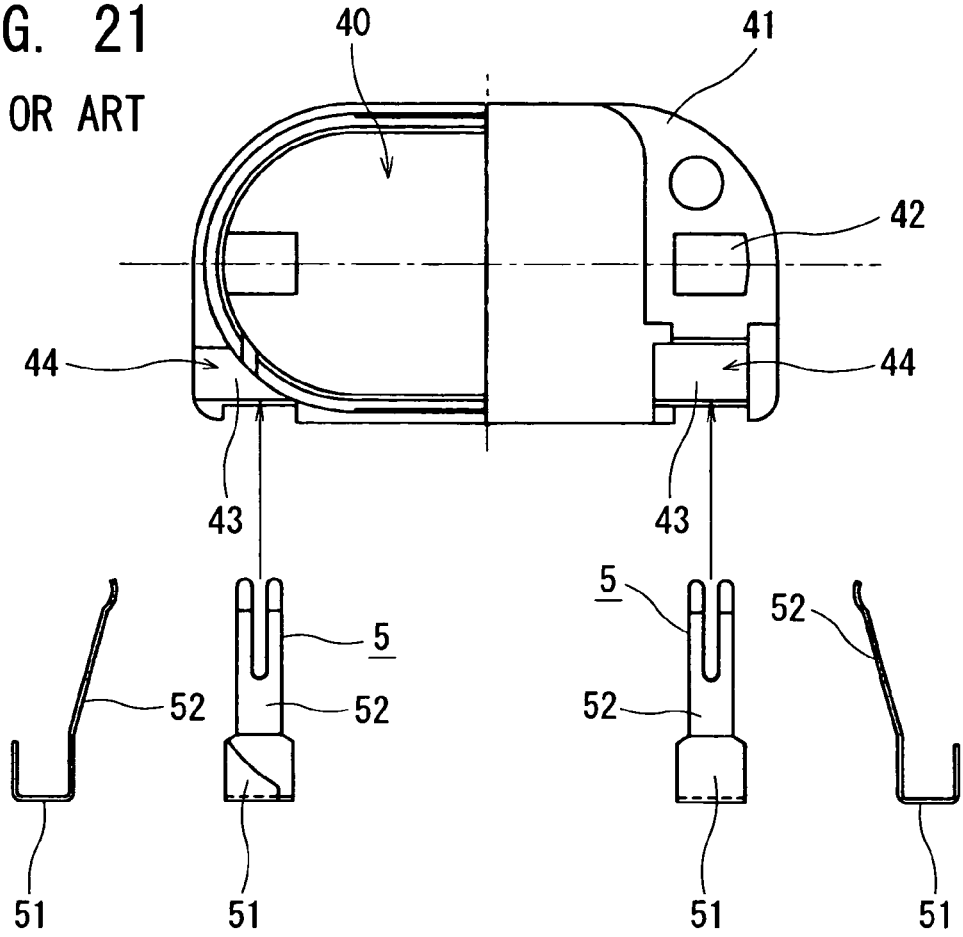
FIG. 21 PRIOR ART
FIG. 21 illustrates a process of attaching an electrode member to a frame of the speaker unit, showing a plan vision of the frame with a left side of the center line viewed from the sound-emitting surface side and a right side viewed from the rear surface side, and a plan vision and a side vision of the electrode member.
Figure 22:
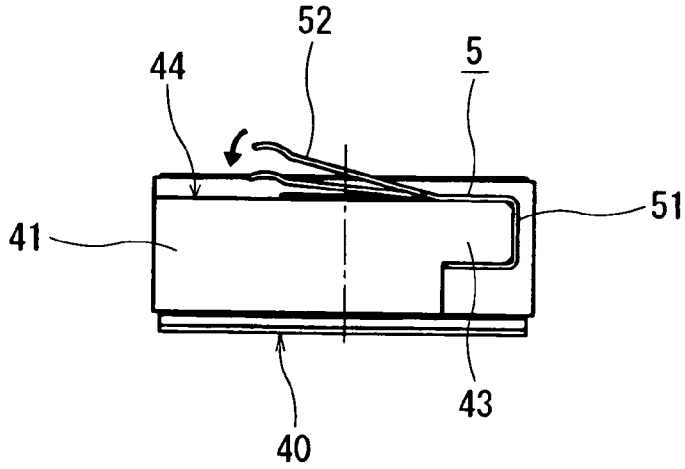
FIG. 22 PRIOR ART
FIG. 22 illustrates an elastic deformation of the electrode member.

As a result, the electrode member 5 of the speaker unit 2 is press-contacted with a pad-(not shown) formed on a surface of the circuit board 12 to produce an electrical connection between the circuit board 12 and the speaker unit 2. In this state, the elastic arm portion 32 of the electrode member 3 elastically deforms as shown in FIG. 14, and an elastic return force thereof maintains the press-contact of the elastic arm portion 32 to the pad.

According to the above-described speaker unit 2 of the present invention, the first locking piece 33 and second locking piece 34 projecting on the clamping portion 31 of the electrode member 3 are engaged with the pair of recesses 24, 25 of the frame 21 with each of the electrode members 3 attached to the frame 21, so that the electrode member 3 can be fixed to the frame 21 without looseness. Therefore, it is unnecessary to fix the electrode member 3 to the frame 21 with an adhesive as conventionally. Furthermore, because a locking structure is used in which two locking pieces 33, 34 are provided at diagonal positions of the clamping portion 31 of the electrode member 3, the electrode member 3 is not only difficult to detach but also positioned stably compared with that of a locking structure using a single locking piece.

Therefore, there is no problem that the electrode member 3 is detached as conventionally when the conductor extending from the coil 71 of the drive mechanism 7 is soldered to the electrode member 3, and high reliability can be obtained in attachment of the electrode member 3. Furthermore, the first locking piece 33 and second locking piece 34 of the electrode member 3 project on the both side edges of the U-shaped portion forming the clamping portion 31. Therefore, a heating area when the conductor (not shown) is soldered to the clamping portion 31 can be larger than in the case of forming the two locking pieces 33, 34 by cutting the middle position of the clamping portion 31, and occurrence of defective soldering can be thereby prevented.

The electrode member 3 is made of a sheet metal, and it is easy to provide the clamping portion 31 having the pair of locking pieces 33, 34 projected thereon. The frame 21 is made of a synthetic resin, and it is also easy to form the pair of recesses 24, 25 thereon. Therefore, production costs are not increased by carrying out the present invention.

The elastic arm portion 32 of the electrode member 3 comes close to the main body rear area 27 of the frame 21 if the elastic arm portion 32 elastically deforms to a posture approximately parallel to the main body rear area 27 of the frame 21 with the speaker unit 2 incorporated into an electronic device such as a portable telephone or the like. However, as shown in FIG. 9(*b*), the above-described step is formed between the clamped portion rear area 26 and main body rear area 27 of the frame 21. Therefore, a space corresponding to the step is assured between the elastic arm portion 32 and the main body rear area 27, and the air hole 22 of the frame 21 is thereby maintained to be widely open. As a result an air flow accompanying a sound of the speaker unit is kept to be good, so that expected low-frequency acoustic characteristics can be obtained.

The present invention is not limited to the foregoing embodiment in construction but can be modified variously by one skilled in the art without departing from the spirit of the present invention as set forth in the appended claims.

What is claimed is:

1. A speaker unit comprising:

a diaphragm with an aspect ratio exceeding one and a drive mechanism for driving the diaphragm in an internal space of a frame made of a synthetic resin, the frame having both ends thereof provided with a pair of air holes opening on a rear surface opposite to a sound-emitting surface, a pair of electrode members for supplying power to the drive mechanism attached to the vicinity of the both air holes, each of the electrode members including a clamping portion for clamping a clamped portion provided at an end of the frame and being fixed to the clamped portion, an elastic arm portion extending from the clamping portion along the rear surface of the frame, the elastic arm portion being opposed to an opening of the air hole, the frame having the rear surface formed with a clamped portion rear area to be in contact with the clamping portion of the electrode member, and a main body rear area having the opening of the air hole facing the elastic arm portion of the electrode member, the main body rear area being formed lower than the clamped portion rear area in a direction apart from the elastic arm portion of the electrode member so that a step is provided between the main body rear area and the clamped portion rear area.

2. The speaker unit according to claim 1, wherein the electrode member is made of a sheet metal, and the clamping portion has a U-shaped cross section, while the elastic arm portion is in the form of a band plate.

* * * * *